US011808453B2

(12) United States Patent
Duan et al.

(10) Patent No.: US 11,808,453 B2
(45) Date of Patent: Nov. 7, 2023

(54) GAS MIXING DEVICE AND GAS WATER HEATING DEVICE

(71) Applicant: A.O. SMITH (CHINA) WATER HEATER CO., LTD., Jiangsu (CN)

(72) Inventors: Yanli Duan, Jiangsu (CN); Ziwen Fu, Jiangsu (CN); Xin Cao, Jiangsu (CN)

(73) Assignee: A.O. Smith Corporation, Milwaukee, WI (US)

( * ) Notice: Subject to any disclaimer, the term of this patent is extended or adjusted under 35 U.S.C. 154(b) by 0 days.

(21) Appl. No.: 17/678,677

(22) Filed: Feb. 23, 2022

(65) Prior Publication Data

US 2022/0228743 A1 Jul. 21, 2022

Related U.S. Application Data

(63) Continuation-in-part of application No. 17/136,541, filed on Dec. 29, 2020, now Pat. No. 11,585,573.

(30) Foreign Application Priority Data

Jun. 24, 2020 (CN) ..... 202021208020.5
Feb. 24, 2021 (CN) ..... 20210412484.6

(51) Int. Cl.
*F23N 1/02* (2006.01)
*F23D 14/02* (2006.01)
(Continued)

(52) U.S. Cl.
CPC ..... *F23N 1/027* (2013.01); *F23D 14/02* (2013.01); *F23D 14/62* (2013.01);
(Continued)

(58) Field of Classification Search
CPC ..... F23D 14/60; F23D 14/62; F23N 1/027
See application file for complete search history.

(56) References Cited

U.S. PATENT DOCUMENTS 4,420,439 A 12/1983 Hartel et al.
4,793,798 A * 12/1988 Sabin ..... F23D 14/22 431/90

(Continued)

FOREIGN PATENT DOCUMENTS

EP 0614045 A1 9/1994
IT 0614045 A1 * 9/1994
WO 2013060997 A2 5/2013

OTHER PUBLICATIONS

Exact Seal, Rubber Diaphragms & Seals (Year: 2019).*

*Primary Examiner* — Steven S Anderson, II
*Assistant Examiner* — Kurt J Wolford
(74) *Attorney, Agent, or Firm* — Michael Best & Friedrich LLP

(57) ABSTRACT

A gas-mixing device includes: a shell, where the shell is provided with an air channel for conveying air, a fuel gas channel for conveying fuel gas, and a mixing-gas channel connecting downstream of the air channel and the fuel gas channel. The fuel gas channel includes a first sectional flow area and the air channel includes a second section flow area; which are located on the movable part of the shell. The movable part is provided with a flexible separation component which hermetically separates the air channel and the fuel gas channel. The movable part penetrates through the flexible separation component and enters the air channel and the fuel gas channel and performs a movement to change the first and second sectional flow area.

20 Claims, 9 Drawing Sheets

(51) Int. Cl.
*F23D 14/62* (2006.01)
*F24H 1/00* (2022.01)

(52) U.S. Cl.
CPC ..... *F23N 2235/02* (2020.01); *F23N 2235/16* (2020.01); *F24H 1/0027* (2013.01)

(56) References Cited

U.S. PATENT DOCUMENTS

| | | | | |
|---|---|---|---|---|
| 2004/0237947 | A1 | 12/2004 | Strohle | |
| 2016/0069563 | A1 | 3/2016 | Cazard | |
| 2018/0231243 | A1* | 8/2018 | Nonoyama | F23L 13/00 |

* cited by examiner

GAS MIXING DEVICE AND GAS WATER HEATING DEVICE

CROSS REFERENCE TO RELATED APPLICATIONS

This application is a continuation-in-part and claims priority to U.S. patent application Ser. No. 17/136,541, filed on Dec. 29, 2020, which claims priority to Chinese Patent Application No. 202021208020.5, filed on Jun. 24, 2020, both of which are hereby incorporated by reference their entirety. This application also claims priority to Chinese Patent Application No. 20210412484.6, filed on Feb. 24, 2021, which is also hereby incorporated by reference its entirety.

TECHNICAL FIELD

The present disclosure relates to the field of gas mixing, in particular to a gas mixing device.

The present disclosure also relates to the field of water heating devices, in particular to a gas water heating device.

BACKGROUND

Fully premixed gas combustion refers to a combustion method in which gas is mixed with adequate air before entering the combustor, and no air is needed during the combustion. The flame propagation speed of fully premixed combustion is high, and the volumetric heat intensity of the combustion chamber is very high, generally up to 28-56*$10^3$ Kw/$m^2$ or higher. Complete combustion can be achieved at a small excess air coefficient, and there is almost no chemical incomplete combustion phenomenon.

In a fully premixed gas water heater, a Venturi premixing device is generally used to ensure full mixing of fuel gas and air, making the air flow velocity field uniform, thereby ensuring that the air flow velocity at each point of the combustor is greater than the flame propagation velocity under the lowest load. At the same time, the uniformity of the flame on the surface of the combustor is ensured, thus the flame on the surface of the combustor is prevented from being too long and contacting the surface of the heat exchanger to cause incomplete combustion.

However, in general, the Venturi tube of the current fully premixed gas water has a relatively small regulation ratio of no more than 1:10, thus the problem that the water temperature is too high under a low load still exists, which, especially in summer, will reduce the user experience. Moreover, there is also a problem of unstable flue gas emission during power regulation.

SUMMARY

In view of the above deficiencies, one purpose of the present disclosure is to provide a gas mixing device and a gas water heating device that can provide a higher regulation ratio, thereby solving the problem that the water temperature is too high in summer.

It is also an object of the present disclosure to provide a gas mixing device and a gas hot water device to be able to provide a higher adjustment ratio.

It is also an object of the present disclosure to provide a gas mixing device and a gas hot water device so as to be able to stabilize stable combustion in a state of low load.

Another purpose of the present disclosure is to provide a gas mixing device and a gas water heating device that can improve the stability of flue gas emission during power regulation.

To achieve the above purposes, the present disclosure adopts the following technical solutions:

A gas mixing device, comprising:

a shell provided with a fuel gas channel for inputting fuel gas, an air channel for inputting air and a gas mixing channel, the fuel gas channel being provided with a first cut-off portion capable of changing a flow area, and the air channel being provided with a second cut-off portion capable of changing a flow area;

a moving part movable in the shell, the moving part simultaneously changing the flow areas of the first cut-off portion and the second cut-off portions by moving.

In at least some embodiments, a movable contraction structure is provided in the shell; the air channel is located inside the contraction structure; the fuel gas channel is located outside the contraction structure; an internal flow area of the contraction structure gradually decreases in an air flow direction to form a contraction section; at least part of the internal flow area of the gas mixing channel gradually increases in an internal gas flow direction to form a diffusion section; and the fuel gas channel is communicated between the contraction section and the diffusion section.

In some embodiments, a ratio of a maximum flow area to a minimum flow area of the first cut-off portion is 10 to 30; and a ratio of a maximum flow area to a minimum flow area of the second cut-off portion is 2 to 6.

In some embodiments, the moving part moves linearly in the shell.

In some embodiments, the moving part comprises an air cut-off plug and a throat that is disposed to sleeve the air cut-off plug; the contraction structure is provided on the throat; an outer wall of the throat and an inner wall of the shell are provided with sealing structures slidable relative to each other; the sealing structures seal and separate the air channel and the fuel gas channel; the air channel is located inside the throat; and the fuel gas channel is located outside the throat.

In some embodiments, the shell is provided with a driving motor, which simultaneously drives the throat to move and drives the air cut-off plug to move relative to the throat, thereby simultaneously changing the flow areas of the first cut-off portion and the second cut-off portion.

In some embodiments, the shell is provided with a gas mixing tube forming the gas mixing channel; the first cut-off portion is formed between the throat and an end portion of the mixing tube; and the second cut-off portion is formed between the throat and the air cut-off plug.

In some embodiments, the air cut-off plug and the throat move synchronously in a predetermined transmission ratio.

In some embodiments, the throat is connected to the air cut-off plug or a motor shaft of the driving motor through a transmission mechanism; the driving motor directly drives the air cut-off plug to move, and the air cut-off plug or the motor shaft of the driving motor causes the throat to move through the transmission mechanism.

In some embodiments, the transmission mechanism is a linkage mechanism.

In some embodiments, the transmission mechanism comprises a first linkage and a second linkage which are rotatably connected through a pivot shaft; wherein one end of the first linkage is rotatably connected to the air cut-off plug or the motor shaft of the driving motor, and one end of the second linkage is rotatably connected to the throat.

In some embodiments, the driving motor is a linear motor; and the air cut-off plug is fixedly disposed to sleeve an output shaft of the linear motor.

In some embodiments, the shell is provided therein with a guide mechanism defining a moving path of the pivot shaft; and when moving in the moving path, the pivot shaft causes the throat to move linearly.

In some embodiments, the outer wall of the throat is provided with a first mating surface which participates in forming the first cut-off portion; the first mating surface has cambered surfaces with different radians in a moving direction of the throat; and the throat moves so that the cambered surfaces with different radians are respectively matched with the gas mixing tube to change the flow area of the first cut-off portion.

In some embodiments, an upper end of the air cut-off plug is provided with a second mating surface which participates in forming the second cut-off portion; the second mating surface has surfaces with different radians in a moving direction of the air cut-off plug; and the air cut-off plug moves so that surfaces with different radians are respectively matched with an inner wall of the throat to change the flow area of the second cut-off portion.

In some embodiments, the driving motor directly drives the throat and the air cut-off plug to move linearly.

In some embodiments, an output end of the driving motor is provided with a first driving gear and a second driving gear which are coaxially disposed; the air cut-off plug is driven by the driving motor through a first rack and the first driving gear to mesh; the throat is driven by the driving motor through a second rack and the second driving gear to mesh; and an addendum circle diameter of the first driving gear is smaller than that of the second driving gear.

In some embodiments, the shell is provided with a gas mixing tube forming the gas mixing channel; the moving part comprises an air cut-off plug and a throat that is disposed to sleeve the air cut-off plug;

the fuel gas channel is provided therein with a baffle plate; the baffle plate is provided with a flow hole which penetrates the baffle plate; the throat is fixedly provided with a shielding structure for shielding the flow hole; and the shielding structure moves to change a shielded area of the flow hole, so as to change the flow area of the first cut-off portion;

the air cut-off plug is fixedly provided with an air cut-off plate; the shell is provided with a variable-diameter portion; and the air cut-off plate and the variable-diameter portion move relative to each other to change the flow area of the second cut-off portion.

In at least some embodiments, a gas mixing device includes:

a shell, wherein the shell is provided with an air channel for conveying air, a fuel gas channel for conveying fuel gas, and a mixing-gas channel communicating with lower reaches of the air channel and the fuel gas channel, wherein the fuel gas channel comprises a first cut-off portion having a changeable flow area and the air channel comprises a second cut-off portion having a changeable flow area; and a movable mechanism arranged in the shell, wherein the movable mechanism is provided with a flexible separation component which separates the air channel and the fuel gas channel, the movable mechanism penetrates through the flexible separation component and enters the air channel and the fuel gas channel and performs a motion to change the flow area of the first cut-off portion and the flow area of the second cut-off portion, and the flexible separation component is able to deform as the movable mechanism performs the motion.

In some embodiments, the movable mechanism performs a linear reciprocating motion.

In some embodiments, a part of the flexible separation component is stable, and another part of the flexible separation component moves along with the movement of the movable part.

In some embodiments, the shell is provided with a connection hole, through which the movable part penetrates, between the air channel and the fuel gas channel, and the flexible separation component is sleeved on the movable mechanism to shield and seal the connection hole.

In some embodiments, the air channel and the fuel gas channel have a shared wall, the connection hole is provided in the shared wall and penetrates through the shared wall, and the flexible separation component comprises a rubber membrane which is fixedly sleeved on the movable mechanism to shield and seal the connection hole.

In some embodiments, an outer periphery of the rubber membrane is fixed by clamping and an inner periphery of the rubber membrane onto the movable part.

In some embodiments, the movable mechanism comprises an air cut-off plate which is driven to move axially, a fuel gas valve core and a linkage rod, and the linkage rod connects with the air cut-off plate and the fuel gas valve core so as to link the fuel gas valve core and the air cut-off plate.

In some embodiments, the linkage rod and the fuel gas valve core are connected via a first elastic piece.

In some embodiments, an air valve port is provided in the air channel, the air cut-off plate has an air blocking position to block the air valve port, and in response to the air cut-off plate being located at the air blocking position, the gas-mixing device also includes a first connection portion which communicates the air channel located at lower reach of the air valve port with the air channel located at upper reach of the air valve port.

In some embodiments, the first connection portion comprises a first constantly open hole which is arranged in the air cut-off plate and penetrates through the air cut-off plate.

In some embodiments, the air valve port is located at a valve port step on an inner wall of the air channel, the valve port step is provided with a flange sealing ring, and the air cut-off plate, when located at the air blocking position, presses the flange sealing ring to hermetically blocks the air valve port.

In some embodiments, a fuel gas valve port is provided in the fuel gas channel, the fuel gas valve core has a fuel gas blocking position at which the fuel gas valve port is blocked, and in response to the fuel gas valve core being located at the fuel gas blocking position, the gas-mixing device also includes a second connection portion which communicates the fuel gas channel located at lower reach of the fuel gas valve port with the fuel gas channel located at upper reach of the fuel gas valve port.

In some embodiments, a fuel gas valve seat is provided in the fuel gas channel, and the fuel gas valve port and the second connection portion are both located on the fuel gas valve seat.

In some embodiments, the second connection portion comprises a second constantly open hole provided in the fuel gas valve seat, and the second constantly open hole is isolated from the fuel gas valve port.

In some embodiments, the fuel gas valve seat comprises a valve port end for the fuel gas valve port, the valve port end comprises a guiding surface that is concave towards the fuel gas valve port at a side away from the linkage rod, and the fuel gas valve core comprises a circumferential protruding periphery which is in contact with the guiding surface and covers and blocks the fuel gas valve port.

In some embodiments, a sealing ring is set to seal and block the fuel gas valve port at a side of the fuel gas valve core circumferential protruding periphery.

In some embodiments, a second elastic piece is provided in the fuel gas channel and the second elastic piece is configured to apply a force to the fuel gas valve core to cause the fuel gas valve core to move towards the blocking position.

In some embodiments, deformation of the second elastic piece when the second elastic piece presses and fixes the fuel gas valve core at the blocking position is adjustable.

In some embodiments, the valve port end of the fuel gas valve seat is further provided with a supporting holder, and the second elastic piece comprises a pressure spring having one end abutting against the supporting holder and another end abutting against the fuel gas valve core.

In some embodiments, the supporting holder accommodates a top hat which is able to move axially, and the pressure spring is compressed and limited between the top hat and the fuel gas valve core.

In some embodiments, the shell is provided with a screw-thread hole which stretches into the fuel gas channel and an adjustment screw which is in screw-thread fit with and penetrates through the screw-thread hole, an end of the adjustment screw abuts against a side of the top hat away from the pressure spring, and a length of a part of the adjustment screw, the part being screwed into screw-thread hole, is changeable by rotating the adjustment screw so as to change a position of the top hat in axial direction.

In some embodiments, the supporting holder comprises a first bulge which protrudes towards the fuel gas valve core, the fuel gas valve core comprises a second bulge which protrudes towards the first bulge, and two ends of the pressure spring are sleeved on the first bulge and the second bulge respectively.

A gas water heating apparatus can include a gas-mixing device according to any of the above embodiments.

Advantageous Effect

The gas mixing device provided in some embodiments of the present disclosure simultaneously changes the flow areas of the first cut-off portion and the second cut-off portion by movement of the moving part, and simultaneously changes the input amount of fuel gas and of air while maintaining a mixing ratio between fuel gas and air to thereby change the amount of the mixed gas in the gas mixing channel. Therefore, the regulation ratio of the gas mixing device can be stably changed, and a stable flue gas emission can be achieved.

The movement of the gas mixing device provided in some embodiments of the present disclosure by the movement mechanism can simultaneously change the over-flow areas of the first and second shut-off portions, and change the input amounts of gas and air while maintaining the gas and air mixing ratio, thereby changing the mixed gas amount of the mixed gas passage, and in turn, the adjustment ratio of the gas mixing device can be stably changed, and the discharge of flue gas can be stabilized.

Also, the gas mixing device of at least some embodiments utilizes a flexible spacer component to space the gas passage and the air passage, and the flexible spacer component can be deformed together with the action of the moving mechanism to accommodate the action of the moving mechanism, thereby reducing interference and influence on the action of the moving mechanism, thereby simultaneously achieving precise control of the intake of gas and air.

Particular embodiments of the present disclosure are disclosed in detail with reference to the descriptions and figures in the following, and the ways in which the principle of the present disclosure can be employed are pointed out. It should be appreciated that the embodiments of the present disclosure are not limited in scope thereby.

Features which are described and/or indicated for one embodiment can be used in one or more other embodiments in an identical or similar way, can be combined with features in the other embodiments, or can replace the features in the other embodiments.

It should be emphasized that the term "comprise/include", when used in this text, refers to the presence of features, integers, steps or components, but does not exclude the presence or addition of one or more other features, integers, steps or components.

BRIEF DESCRIPTION OF THE DRAWINGS

In order to explain more clearly the technical solutions in the embodiments in the present disclosure or in the prior art, the following will briefly introduce the figures needed in the description of the embodiments or the prior art. Obviously, figures in the following description are only some embodiments of the present disclosure, and for a person skilled in the art, other figures may also be obtained based on these figures without paying any creative effort.

DETAILED DESCRIPTION

In order to enable persons skilled in the art to better understand the technical solutions in the present disclosure, a clear and comprehensive description to the technical solutions in the embodiments of the present disclosure will be given in the following in combination with the figures in the embodiments of the present disclosure, and obviously, the embodiments described are only part of the embodiments of the present disclosure, rather than all the embodiments of the present disclosure. Based on the embodiments of the present disclosure, all other embodiments obtained by ordinary skilled persons in this field without paying any creative effort should pertain to the scope of protection of the present disclosure.

What needs to be explained is that, when an element is referred to as being "provided on" another element, it can be directly on the other element, or an intervening element may also be present. When an element is considered to be "connected to" another element, it can be directly connected to the other element, or an intervening element may also be present. The terms "perpendicular", "horizontal", "left" and "right" as well as similar expressions used in this text are only for the purpose of explanation, and do not represent a unique embodiment.

Unless otherwise defined, all technical and scientific terms used in this text have the same meaning as commonly understood by persons pertaining to the technical field of the present disclosure. The terminology used in the description of the present invention is for the purpose of describing the specific embodiments only, and is not intended to limit the present disclosure. The term "and/or" used in the text includes any and all combinations of one or more of the associated listed items.

Figure 1:
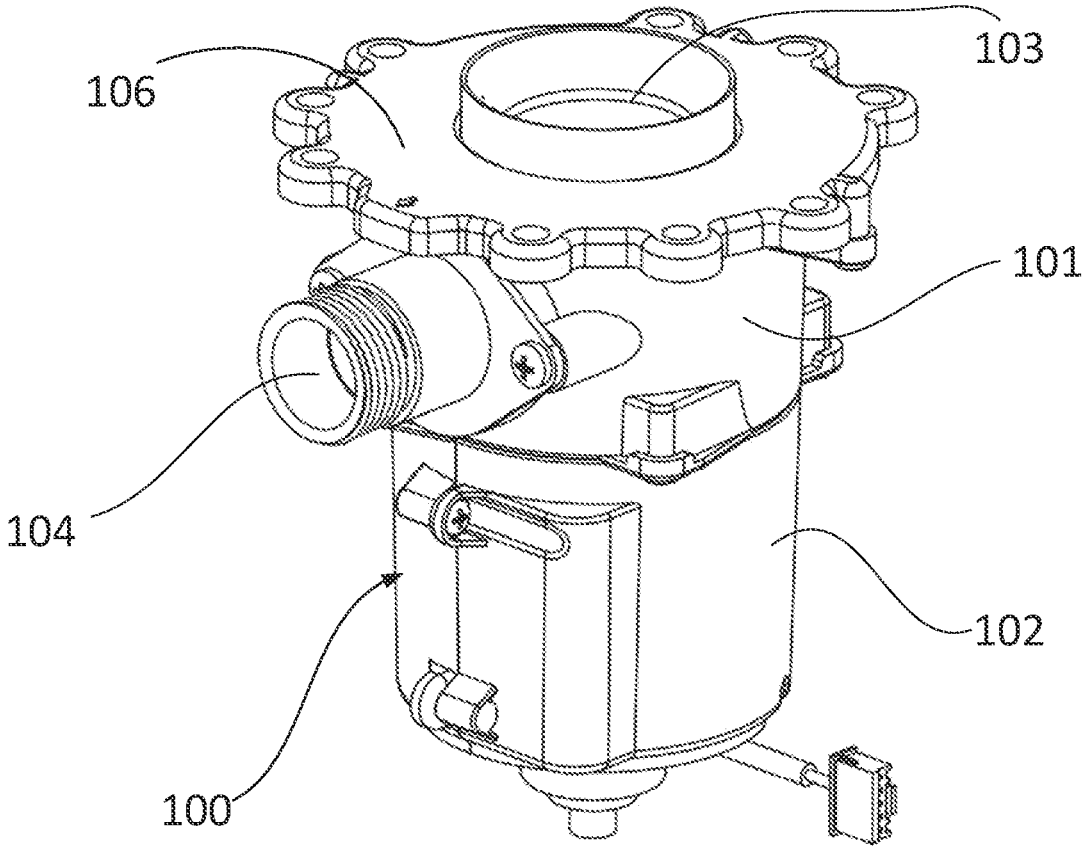
FIG. 1 is a structural diagram of a gas mixing device provided by an embodiment of the present disclosure.
Figure 2:
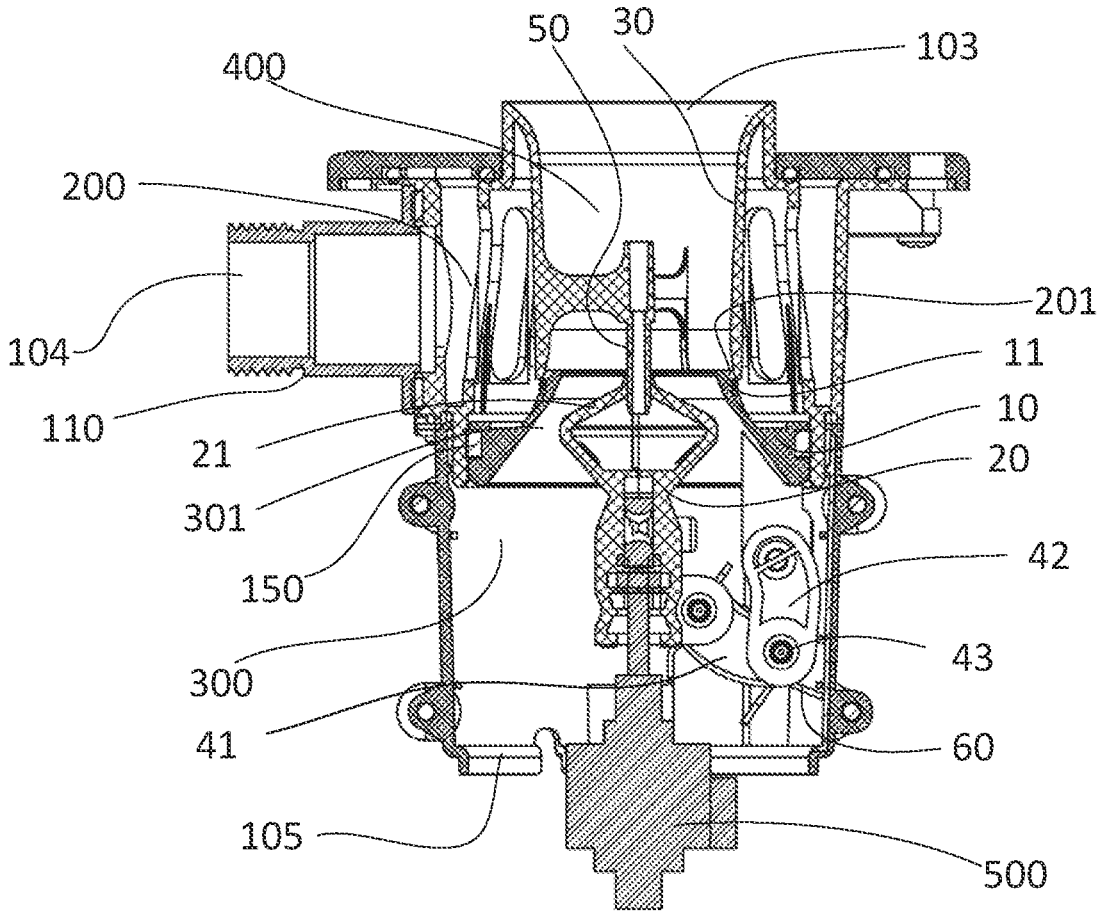
FIG. 2 is a cutaway view of FIG. 1.

Referring to FIGS. 1 and 2, an embodiment of the present disclosure provides a gas mixing device, comprising: a shell 100, and a moving part movable in the shell 100, wherein, the shell 100 is provided with a fuel gas channel 200 for inputting fuel gas, an air channel 300 for inputting air and a gas mixing channel 400. The fuel gas channel 200 is provided with a first cut-off portion 201 capable of changing a flow area, and the air channel 300 is provided with a second cut-off portion 301 capable of changing a flow area. The moving part simultaneously changes the flow areas of the first cut-off portion 201 and the second cut-off portion 301 by moving.

The gas mixing device provided by the present disclosure simultaneously changes the flow areas of the first cut-off portion 201 and the second cut-off portion 301 by movement of the moving part, and simultaneously changes the input amount of fuel gas and of air while maintaining a mixing ratio between fuel gas and air to thereby change the amount of the mixed gas in the gas mixing channel 400. Therefore, the regulation ratio of the gas mixing device can be stably changed, and a stable flue gas emission can be achieved.

The gas mixing device of this embodiment coordinately changes the fan speed during the change of the regulation ratio, so that the flue gas is stable. High regulation ratio solves the problem that the water temperature is too high in summer. A higher regulation ratio can be realized, lower power can be achieved, a more stable low-load combustion can be maintained.

The gas mixing device of this embodiment is a Venturi tube of a special structure. The air channel 300, the fuel gas channel 200 and the gas mixing channel 400 form the Venturi structure. Air flows through the air channel 300 towards the gas mixing channel 400, generating a negative pressure which forms suction of the fuel gas in the fuel gas channel 200.

To be specific, a movable contraction structure is provided in the shell 100. The contraction structure is a conical structure as a whole. The air channel 300 is located inside the contraction structure. The fuel gas channel 200 is located outside the contraction structure. An internal flow area of the contraction structure gradually decreases in an air flow direction to form a contraction section. At least part of the internal flow area of the gas mixing channel 400 gradually increases in an internal gas flow direction to form a diffusion section, and a mixed gas outlet 103 is formed at the tail end of it. The fuel gas channel 200 is communicated between the contraction section and the diffusion section. Between the contraction section and the diffusion section may be a throat having a flow area that is substantially unchanged in the flow direction. The fuel gas channel 200 is in communication with the throat.

In this embodiment, the moving part may be a single element, and may also be assembled from a plurality of elements. The moving part may comprise a plurality of elements driven directly or indirectly by a driving motor 500. The motion forms of the elements may be the same or different, and the present disclosure does not give limitations to this. The movement form of the moving part in the shell 100 may be rotation, translation and swing, and may even be a combination of a plurality of motions. In this embodiment, the moving part moves linearly in the shell 100. The driving motor 500 has a motor shaft, the moving part can be mounted on the motor shaft, and the moving part can move in an axial direction.

To be specific, the moving part comprises an air cut-off plug 20 and a throat 10 that is disposed to sleeve the air cut-off plug 20. The contraction structure is provided on the throat 10. The contraction structure is a part of the throat 10. The throat 10 can move to change the flow area of the first cut-off portion. The outer wall of the throat 10 and the inner wall of the shell 100 are provided with sealing structures slidable relative to each other. The sealing structures seal and separate the air channel 300 and the fuel gas channel 200. The air channel 300 is located inside the throat 10. The fuel gas channel 200 is located outside the throat 10. The sealing structure may comprise a sealing ring 150 provided on the outer wall of the lower end of the throat 10. The sealing ring 150 and the inner wall of the lower end of the upper shell 101 are fitted and sealed with each other. The throat 10 of a conical structure projects upwardly.

The shell 100 is provided with a gas mixing tube 30 forming the gas mixing channel 400. The upper end 11 of the throat 10 extends into the gas mixing tube 30. The throat 10 and the gas mixing tube 30 are coaxially provided. The first cut-off portion 201 is formed between the throat 10 and an end portion (the lower end) of the gas mixing tube 30. The second cut-off portion 301 is formed between the throat 10 (the inner wall) and the air cut-off plug 20 (the upper end 21). The first cut-off portion 201 is located at any position of the fuel gas channel 200, i.e. may be located at the tail end, entry end or even a middle position of the fuel gas channel 200. In this embodiment, the first cut-off portion 201 is substantially located at the tail end of the fuel gas channel 200, and fuel gas enters the gas mixing channel 400 after being discharged from the first cut-off portion 201. The second cut-off portion 301 is substantially located at the tail end of the air channel 300, and air enters the gas mixing channel 400 after being discharged from the second cut-off portion 301.

As shown in FIGS. 1 and 2, the air channel 300 has an air inlet 105 that may be communicated with a silencer device. The shell 100 comprises an upper shell 101 and a lower shell 102. The air inlet 105 is located at the lower end of the lower shell 102. The lower end of the upper shell 101 and the upper end of the lower shell 102 are fixedly connected. An upper end cover 106 covers and seals the upper end of the upper shell 101. The gas mixing tube 30 is coaxially provided on the upper end cover 106, forming a mixed gas outlet 103 at the upper end thereof. The throat 10 is located in the shell 100 and moves approximately at the connection part between the upper shell 101 and the lower shell 102. The throat 10 and the gas mixing tube 30 are provided to be coaxial. The fuel gas channel 200 is formed among the throat 10 and gas mixing tube 30 and the upper shell 101, and is located outside the throat 10 and gas mixing tube 30.

In this embodiment, the side wall of the upper shell 101 has a gas side tube 110, which having a fuel gas inlet 104 for inputting fuel gas. The air channel 300 is located inside the throat 10. When facing FIG. 2, the air channel 300 is located on the lower side of the throat 10, and the fuel gas channel 200 and gas mixing channel 400 are located on the upper side of the throat 10.

What needs to be explained is that the upward and downward orientations described in this embodiment are defined based on the orientation facing FIG. 2. In actual use, the installation and use of the gas mixing device is not limited to the state shown in FIG. 2. The gas mixing device does not have to be used in the state shown in FIG. 2. Correspondingly, the "upper end" and "lower end" described in this embodiment may also be changed adaptively. For example, when an actual gas mixing device is in a state opposite (installed inversely) to the state shown in FIG. 2, the "upper end" described in this embodiment becomes the "lower end", and there is no such limitation that the "upper end" described in this embodiment must be the "top end" in use.

In this embodiment, the shell 100 is provided with a driving motor 500. The driving motor 500 is fixedly mounted at the lower end of the shell 100. The driving motor 500 simultaneously drives the throat 10 to move and drives the air cut-off plug 20 to move relative to the throat 10, thereby simultaneously changing the flow areas of the first cut-off portion 201 and the second cut-off portion 301. To be specific, the driving motor 500 can directly drive the air cut-off plug 20 to move and indirectly drive the throat 10 (e.g., the throat 10 can be caused to move by means of the air cut-off plug 20), and can also directly drive the throat 10 to move and indirectly drive the air cut-off plug 20 (e.g., the air cut-off plug 20 can be caused to move by means of the throat 10). Of course, the driving motor 500 can also directly drive the air cut-off plug 20 and the throat 10 simultaneously.

The motions of the air cut-off plug 20 and the throat 10 may be the same, i.e. they move synchronously and equidistantly. That is, the air cut-off plug 20 and the throat 10 have the same speed when doing linear movements, and the transmission ratio between the two is 1:1. In this embodiment, the air cut-off plug 20 and the throat 10 move synchronously in a predetermined transmission ratio. To be specific, considering the mixing ratio between air and fuel gas, the moving speed of the air cut-off plug 20 may be greater than that of the throat 10. The change rate of the flow area of the first cut-off portion 201 may be greater than that of the second cut-off portion 301. The linear movements of the air cut-off plug 20 and the throat 10 are not equal in speed. The air cut-off plug 20 and the throat 10 move upwardly or downwardly together at different speeds to maintain a certain mixing ratio between fuel gas and air, thereby ensuring the stability of combustion.

In this embodiment, in order to realize the linear movements of the air cut-off plug 20 and the throat 10, the driving motor 500 can be a linear motor, and the air cut-off plug 20 is fixedly disposed to sleeve the output shaft (motor shaft) of the linear motor 500. The air cut-off plug 20 can be mounted on the output shaft of the linear motor 500 to perform a linear movement together with the output shaft. The air cut-off plug 20, when moving linearly, causes the throat 10 to move linearly as well.

In order to realize the movement of the throat 10, the throat 10 is connected to the air cut-off plug 20 or the motor shaft of the driving motor by means of a transmission mechanism. The driving motor 500 directly drives the air cut-off plug 20 to move, and the air cut-off plug 20 or the motor shaft of the driving motor causes the throat 10 to move by means of the transmission mechanism. As shown in FIG. 2, the air cut-off plug 20 is fixedly disposed to sleeve the motor shaft of the linear motor 500, and the air cut-off plug 20 is connected to the throat 10 by means of the transmission mechanism. The transmission mechanism is a linkage mechanism by means of which the movement of the air cut-off plug 20 is transmitted to the throat 10, so that when the air cut-oft plug 20 moves, it causes the throat 10 to move together with it, and the two maintain a predetermined transmission ratio. Hence, a certain mixing ratio between fuel gas and air is maintained, and the stability of combustion is ensured.

In this embodiment, the transmission mechanism is a linkage mechanism. To be specific, the transmission mechanism comprises a first linkage 41 and a second linkage 42 rotatably connected via a pivot shaft 43. One end of the first linkage 41 is rotatably connected to the air cut-off plug 20, and one end of the second linkage 42 is rotatably connected to the throat 10. In this embodiment, one end of the first linkage 41 may also be directly and rotatably connected to the motor shaft of the driving motor 500, in which case the throat 10 can also be caused to move by means of the transmission mechanism.

As can be seen in FIG. 2, in order to avoid interference on the moving path, the first linkage 41 and the second linkage 42 are curved or micro-bent structures. Of course, in other embodiments, the first linkage 41 and the second linkage 42 can also be straight rods, and the present disclosure does not make a unique limitation. The two ends of the first linkage 41 are respectively hinged to the lower end of the air cut-off plug 20 and one end of the second linkage 42, and the other end of the second linkage 42 is hinged to the lower end of the throat 10. In order to facilitate connection and assembly, the lower end of the throat 10 can extend to form a connection section to be hinged with an end of the second linkage 42. Of course, an end of the second linkage 42 can also be directly hinged with the main body of the throat 10. It can be seen that the transmission mechanism in this embodiment has a simple structure, is easy to assemble and has a low manufacture cost. Moreover, it can keep the throat 10 and air cut-off plug 20 in transmission with a predetermined transmission ratio. An appropriate mixing ratio between fuel gas and air can be maintained while realizing a synchronized movement of the two.

In order to ensure a stable change of the flow areas of the first cut-off portion 201 and the second cut-off portion 301, the shell 100 is provided with a guide structure 50 for guiding the movement of the moving part, enabling the moving part to move stably, thereby changing the combustion power stably. To be specific, the guide structure 50 can guide one of the air cut-off plug 20 and the throat 10. In this embodiment, the guide structure 50 is provided on the gas mixing tube 30. The guide structure 50 comprises a guide rod provided on the gas mixing tube 30. The guide rod and the gas mixing tube 30 are coaxially provided. The upper end of the air cut-off plug 20 is disposed to sleeve the guide rod and slidable relative to the guide rod. When the air cut-off plug 20 performs a linear movement (e.g., the up-down movement shown in FIG. 2), the length of the guide rod extending into the air cut-of plug 20 changes, but the guide rod remains extending into the air cut-off plug 20.

Therefore, guiding for the movement of the air cut-off plug 20 is maintained. Of course, the movement of the throat 10 can also be guide by the slidable sealing between the throat 10 and the shell 100.

In this embodiment, the shell 100 is provided therein with a guide mechanism 60 defining a moving path of the pivot shaft 43. When moving in the moving path, the pivot shaft 43 causes the throat 10 to move linearly. As shown in FIG. 2, the guide mechanism 60 is a guide groove fixed on the inner wall of the lower shell 102. The guide groove is disposed obliquely. The end of it close to the air cut-off plug 20 is the upper end, and the end of it away from the air cut-off plug 20 is the lower end. The guide groove is a linear groove. When the air cut-off plug 20 moves downwardly, the pivot shaft 43 moves towards the lower right side (based on the orientation facing FIG. 2) along the guide mechanism (guide groove), and when the air cut-off plug 20 moves upwardly, the pivot 43 moves towards the upper left side.

In this embodiment, the first cut-off portion 201 is the part of the whole fuel gas channel 200 which has the minimum flow area. By changing the size of the flow area of the first cut-off portion 201, the adjustment of the fuel gas supply amount of the fuel gas channel 200 is realized. Correspondingly, the second cut-off portion 301 is the part of the whole air channel 300 which has the minimum flow area. By changing the size of the flow area of the second cut-off portion 301, the adjustment of the air supply amount of the air channel 300 is realized.

To achieve a greater regulation ratio, the ratio of the maximum flow area to the minimum flow area of the first cut-off portion 201 is 10 to 30. For example, the ratio of the maximum flow area to the minimum flow area of the first cut-off portion 201 is around 20. The ratio of the maximum flow area to the minimum flow area of the second cut-off portion 301 is 2 to 6. For example, the ratio of the maximum flow area to the minimum flow area of the second cut-off portion 301 is around 4. The regulation ratio of the gas mixing device provided in FIGS. 1 and 2 can reach 1:20 or above. To be more specific, the regulation ratio of the gas mixing device can reach 1:22, and the gas mixing device can have a lower combustion power and a more stable regulation process, and thereby allows the flue gas emission to be stable and not easy to exceed certain standards during combustion power regulation.

Figure 3:
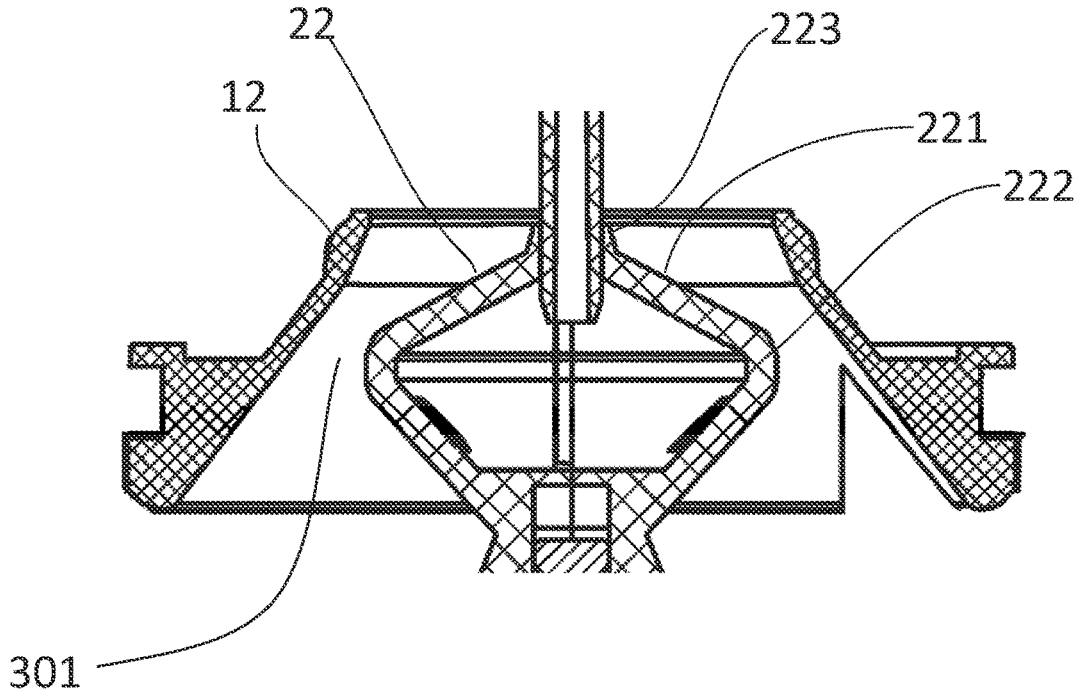
FIG. 3 is a partial enlarged view of FIG. 2.

In this embodiment, the air cut-off plug 20 and the throat 10 are designed to have gradually varied radians, and the regulation ratio of the gas mixing device (Venturi tube) is changed through the radians to achieve a relative large regulation ratio is achieved. Referring to FIGS. 2 and 3, the outer wall of the throat 10 is provided with a first mating surface 12 which participates in forming the first cut-off portion 201. The first mating surface 12 has cambered surfaces with different radians in a moving direction of the throat 10. The throat 10 moves so that cambered surfaces with different radians are respectively matched with the gas mixing tube 30 to change the flow area of the first cut-off portion 201.

In this embodiment, the first mating surface 12 is disposed on the outer wall of the upper end 11 of the throat 10, and the upper end 11 of the throat 10 extends into the lower end of the gas mixing tube 30. The first cut-off portion 201 is formed between the first mating surface 12 and the inner wall of the lower end of the gas mixing tube 30. The first mating surface 12 can be approximately three cambered surfaces of different radians. The cambered surface in the middle projects outwardly, and a smooth transition exist between the cambered surfaces on two sides and the cambered surface in the middle, so that a smooth regulation of the regulation ratio is realized.

The upper end of the air cut-off plug 20 is provided with a second mating surface 22 which participates in forming the second cut-off portion 301. The second mating surface 22 has cambered surfaces with different radians in a moving direction of the air cut-off plug 20. The air cut-off plug 20 moves so that cambered surfaces with different radians are respectively matched with the inner wall of the throat 10 to change the flow area of the second cut-off portion 301. The second cut-off portion 301 is formed between the second mating surface 22 and the inner wall of the throat 10. Referring to FIGS. 2 and 3, the upper end of the air cut-off plug 20 is approximately a diamond structure, the second mating surface 22 also includes approximately three cambered surfaces 221, 222, 223 of different radians, wherein the cambered surface 221 in the middle as a whole is a conical surface, and in fact is a cambered surface with a relative large radian.

In other embodiments, the driving motor 500 can directly drive the throat 10 and the air cut-off plug 20 to move linearly. No transmission mechanism is required between the throat 10 and the air cut-off plug 20, and the motions of the two are the same. The throat 10 and the air cut-off plug 20 can both be fixedly connected to the output shaft of the driving motor 500 directly, or can be respectively driven by the output shaft, or the throat 10 and the air cut-off plug 20 can be fixedly connected to each other with one of them being directly driven by the output shaft of the driving motor 500, so that they are driven together.

In addition, in other embodiments, the transmission mechanism is not limited to a linkage mechanism. For example, the transmission mechanism may also be a worm gear and worm rod, a gear and chain, belt transmission and so on.

Figure 6:
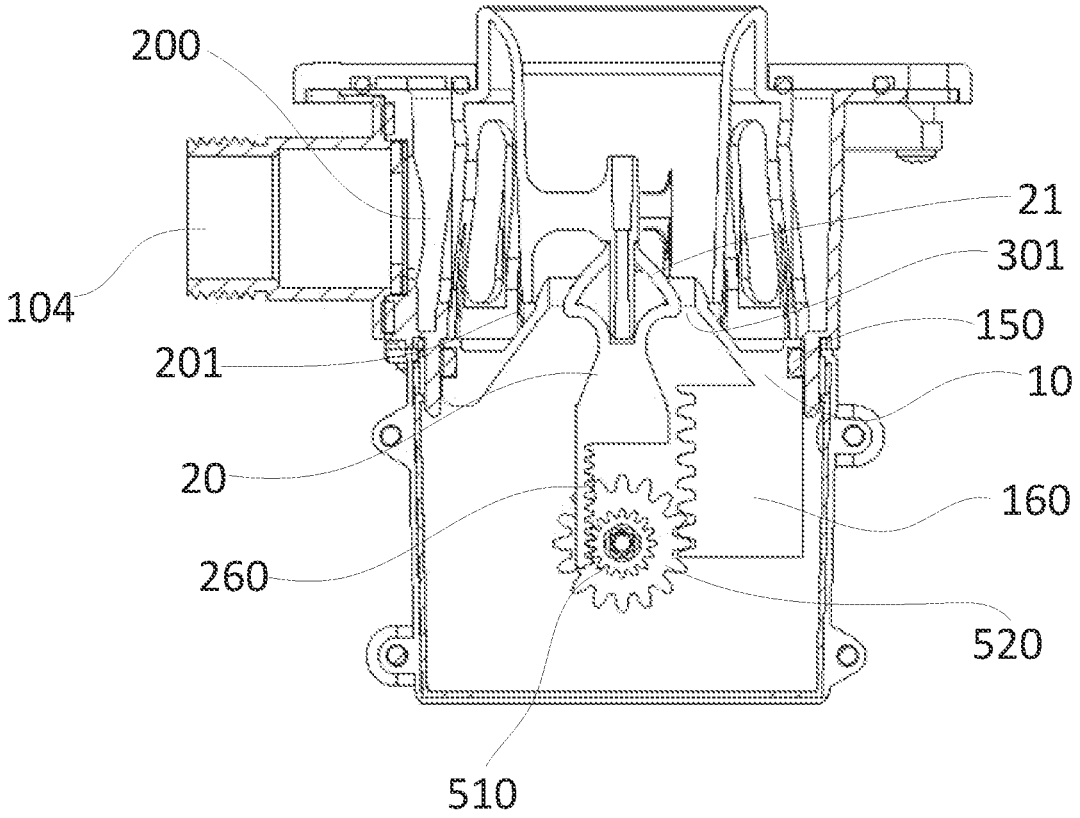
FIG. 6 is a structural cutaway view of a gas mixing device provided by another embodiment of the present disclosure.
Figure 7:
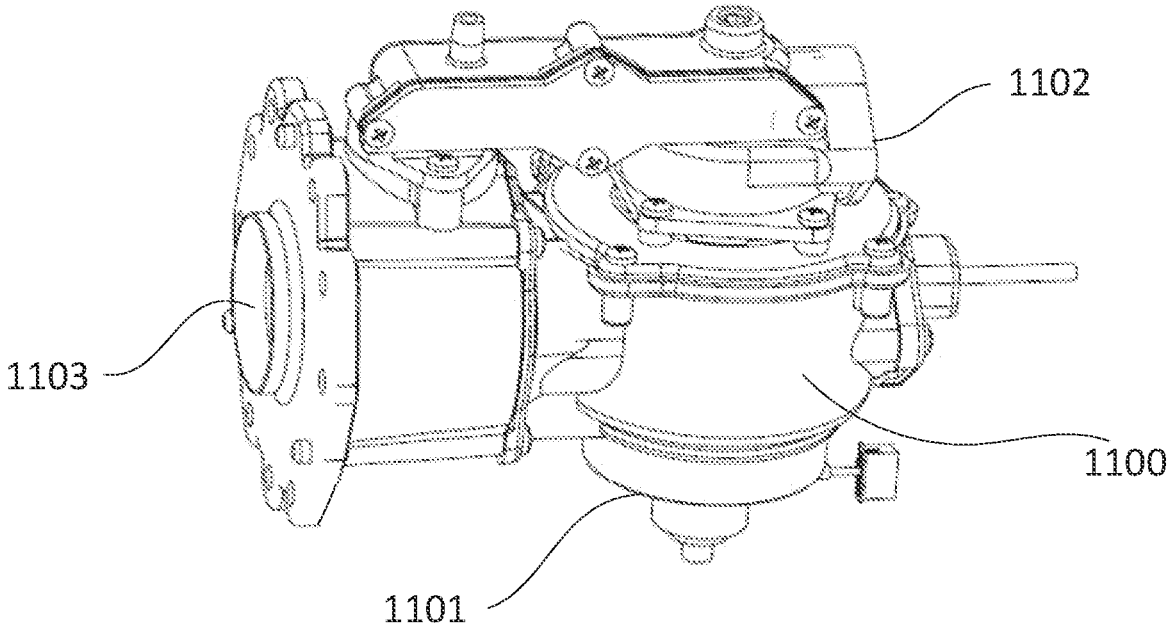
FIG. 7 is a perspective view of a gas mixing device provided in another embodiment of the present disclosure.
Figure 8:
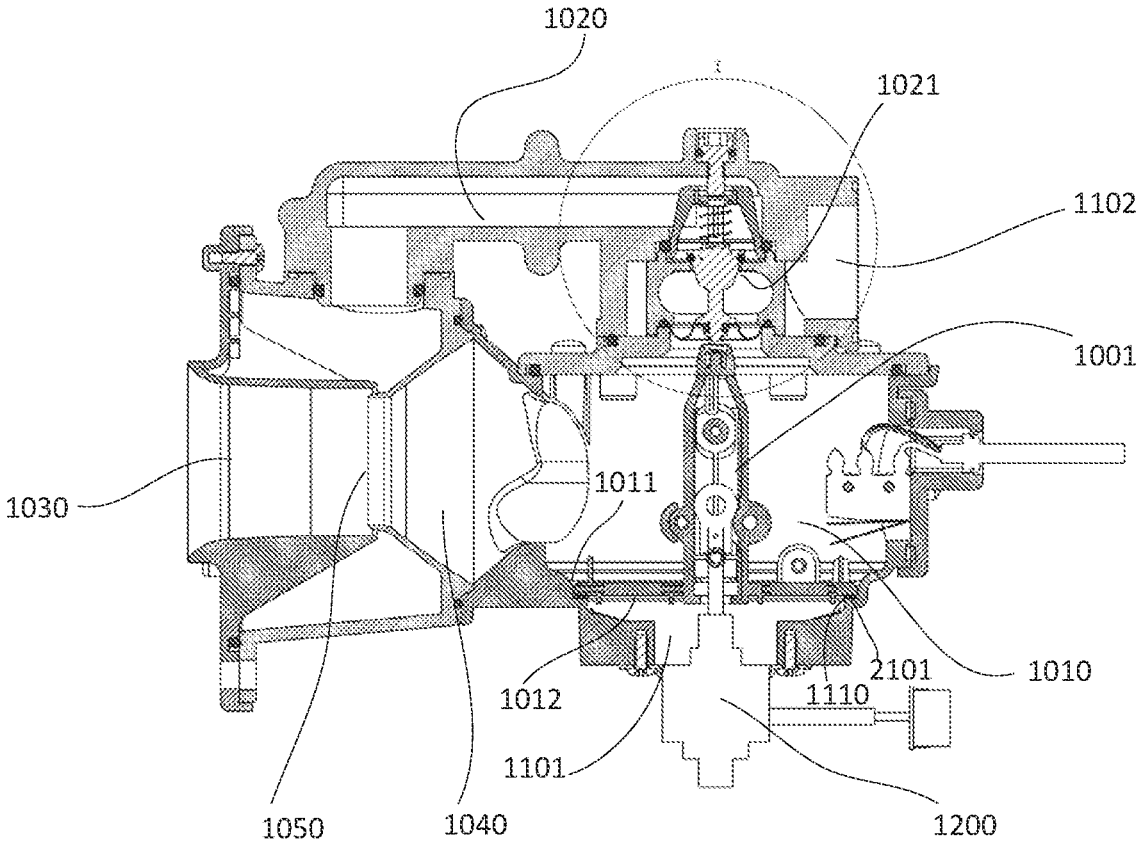
FIG. 8 is a cross-sectional view of FIG. 7.

In a feasible embodiment as shown in FIG. 6, the driving motor 500 directly drives the throat 10 and the air cut-off plug 20. The output end of the driving motor 500 is provided with a first driving gear 510 and a second driving gear 520 which are coaxially disposed. The air cut-off plug 20 is driven by the driving motor 500 through a first rack 260 and the first driving gear 510 to mesh. The throat 10 is driven by the driving motor 500 through a second rack 160 and the second driving gear 520 to mesh.

The addendum circle diameter of the first driving gear 510 is smaller than that of the second driving gear 520. The screw pitches of the first drive gear 510 and the second drive gear 520 are different. In this embodiment, the above linkage mechanism is changed to be the gear and rack with different screw pitches in this embodiment to realize a synchronous and coaxial linear motion of air and fuel gas at different distances.

For the air cut-off plug 20, throat 10 and gas mixing tube 30 in this embodiment, reference can be made to the description in the embodiment of FIGS. 1 and 2, and no redundant depiction will be given in this embodiment.

Figure 4:
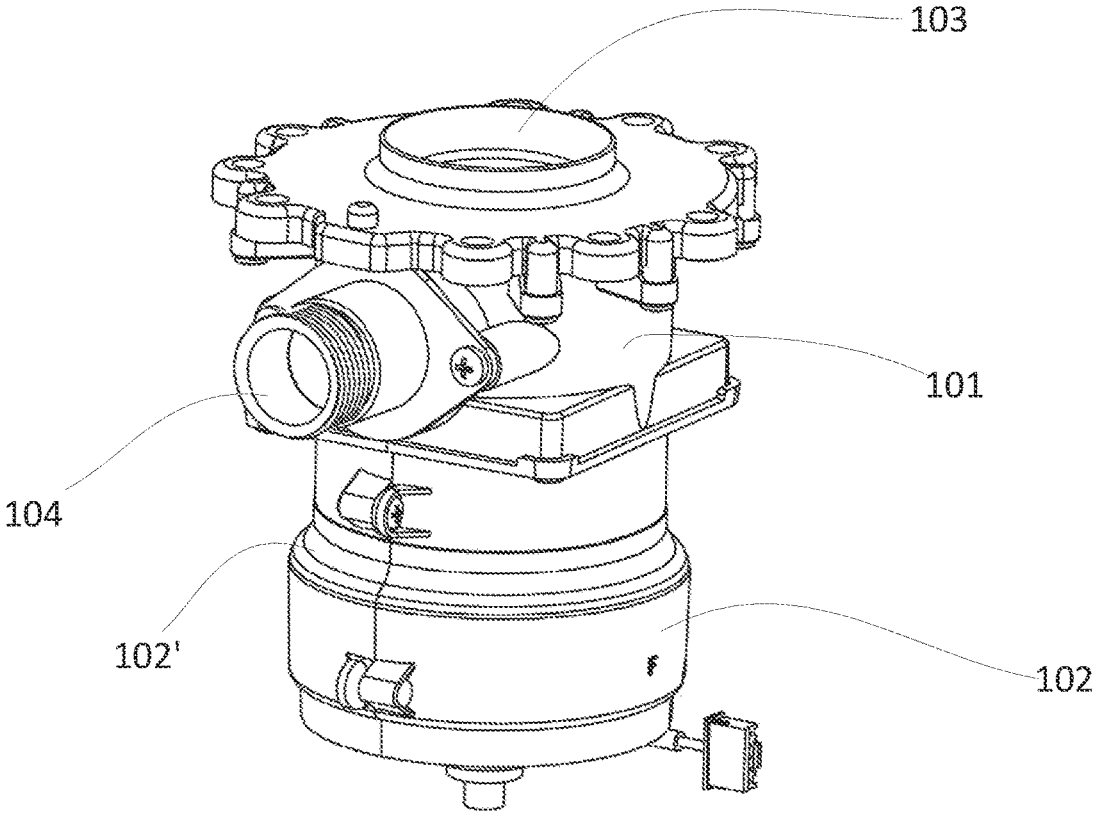
FIG. 4 is a structural diagram of a gas mixing device provided by another embodiment of the present disclosure.
Figure 5:
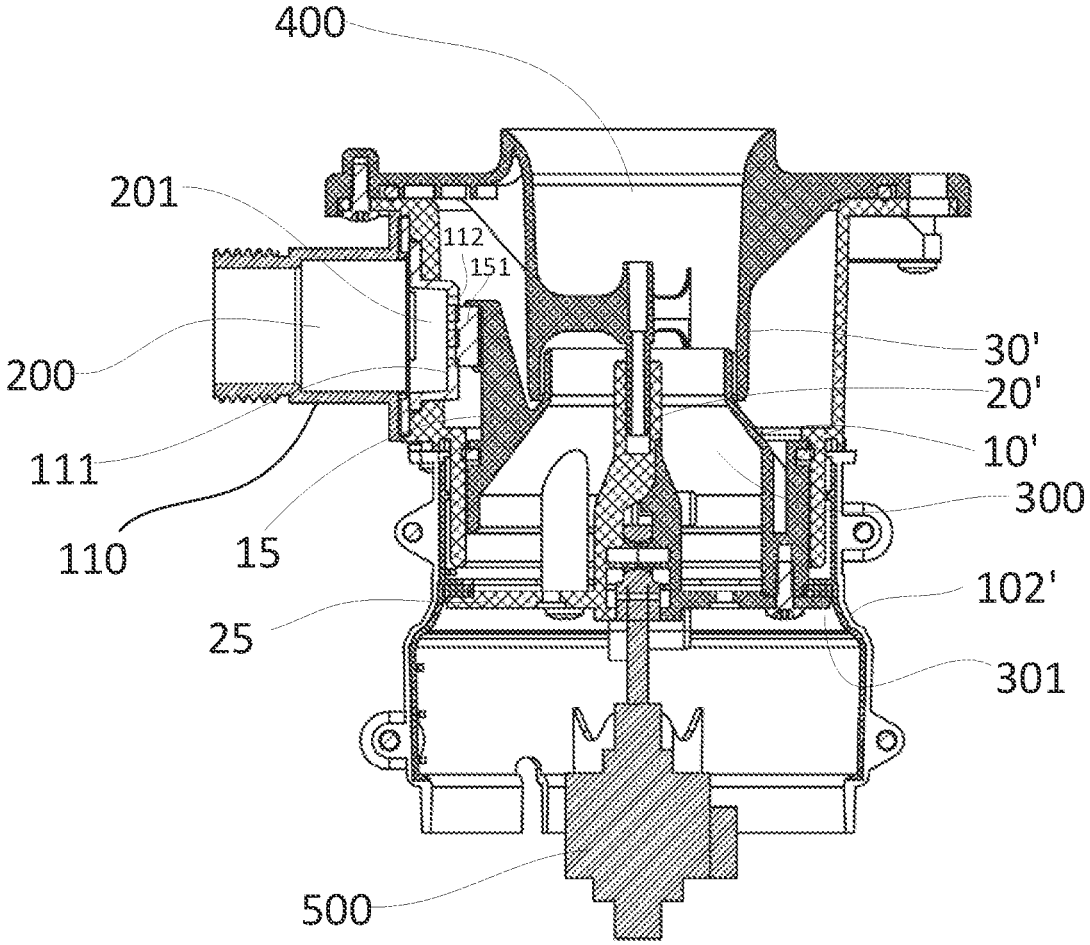
FIG. 5 is a cutaway view of FIG. 4.

In another specific embodiment, as can be seen from FIGS. 4 and 5, the shell 100 is provided with a gas mixing tube 30' forming the gas mixing channel 400. The moving part comprises an air cut-off plug 20' and a throat 10' that is disposed to sleeve the air cut-off plug 20'. The upper end of the throat 10' is cylindrical. The upper end of the cylinder always extends into the gas mixing pipe 30' during the movement of the throat 10', thus the flow area there is namely the cross sectional area of the annular space between the cylindrical upper end and the gas mixing tube 30'.

Besides, the flow area between the throat 10' and gas mixing tube 30' remains unchanged during the movement of the throat 10'.

A baffle plate 111 is provided in the fuel gas channel 200. The baffle plate 111 is provided with a flow hole 112 which penetrates the baffle plate. The flow area (the cross sectional area) between the throat 10' and the gas mixing tube 30' is greater than the flow area of the first cut-off portion 201. Preferably, the flow area between the throat 10' and the gas mixing tube 30' is greater than the area of the flow hole 112 which is not shielded (the maximum flow area of the first cut-off portion 201). The side wall of the upper shell 101 has a fuel gas side tube 110, the baffle plate 111 is located at the tail end of the fuel gas side tube 110, and fuel gas passes through the flow hole 112 of the baffle plate 111 and enter the inner cavity of the upper shell 101 (the annulus space between the inner wall of the shell 101 and the gas mixing tube 30'). The overall fuel gas side tube 110 is perpendicular to the gas mixing tube 30', and the flow hole 112 faces towards the side wall of the gas mixing tube 30'.

To be specific, the communication area of the flow hole 112 is namely the flow area of the first cut-off portion 201. The baffle plate 111 may be a porous wall surface structure, the flow hole 112 comprises a plurality of air holes distributed on the baffle plate 111, which can be arranged to be an approximately triangular structure, and the number of the air holes increases gradually from top to bottom. Of course, in other embodiments, the flow hole may be a single triangular hole, so that the flow area of the first cut-off portion 201 can be smoothly changed.

The throat 10' is fixedly provided with a shielding structure 15 for shielding the flow hole 112. The shielding structure 15 moves to change a shielded area of the flow hole 112, so as to change the flow area of the first cut-off portion 201. The shielding structure 15 changes the number of the shielded air holes to change the communication area of the flow hole 112, and thus the flow area of the first cut-off portion 201 can be changed. The shielding structure 15 is disposed on the outer side wall of the throat 10' and is provided with fuel gas cut-off cotton 151, and thus has a better sealing effect when being attached to the inner wall surface of the baffle plate 111, so that fuel gas can pass through the part of the flow hole 112 which is not shielded.

The air cut-off plug 20' is fixedly provided with an air cut-off plate 25. The shell 100 is provided with a variable-diameter portion 102'. The variable-diameter portion 102' is located on the lower shell 102. In this embodiment, the internal cross sectional area (flow area) of the variable-diameter portion 102' decreases gradually in the air flow direction. When the inner cavity cross section of the lower shell 102 is circular, the internal diameter of the variable-diameter portion 102' decreases gradually in the air flow direction. The air cut-off plate 25 and the variable-diameter portion move relative to each other to change the flow area of the second cut-off portion 301.

To be specific, the upper end of the air cut-off plug 20' does not need to have the structure shown in FIGS. 1 and 2, and the air cut-off plug 20' can be a cylindrical structure as a whole. The flow area between the air cut-off plug 20' and the inner wall of the throat 10' is always greater than the flow area between the air cut-off plate 25 and the variable-diameter portion 102'. Hence, the second cut-off portion 301 is formed between the air cut-off plate 25 and the variable-diameter portion 102' and the change of the flow area between the air cut-off plate 25 and the variable-diameter portion 102' can affect the amount of air. The air cut-off plate 25 is fixedly connected to the lower end of the air cut-off plug 20'. The relative position of the air cut-off plate 25 in the variable-diameter portion 102' is changed by the axial movement (linear movement or up and down movement) of the air cut-off plate 25, and accordingly the flow area of the annular channel between the air cut-off plate and the variable-diameter portion 102' is changed corresponding to parts of the variable-diameter portion 102' that have different cross sectional areas.

In this embodiment, the throat 10', the air cut-off plate 25 and the air cut-off plug 20' are assembled into one piece and move coaxially, synchronously and equidistantly with the motor 500 as the (linear) motor 500 extends and contracts.

Based on the same idea, the embodiments of the present disclosure also provide a gas water heating device as described in the following embodiments. Since the principles by which the gas water heating device solves problems and the technical effects which the gas water heating device can achieve are similar to that of the gas mixing device. Reference can be made to the implementation of the gas mixing device described above for the implementation of the gas water heating device. No redundant depiction will be given for the repeated content.

A further embodiment of the present disclosure provides a gas water heating device comprising the gas mixing device according to any one of the above embodiments. The gas mixing device can be communicated upstream of the combustor of the gas water heating device for providing premixed gas to the combustor and providing fuel gas to the combustor. The gas water heating device is preferably a fully premixed gas water heater.

Referring now to FIGS. 7 to 13, a gas mixing device is provided that includes a housing 1100, a movement mechanism 1001 disposed within said housing 1100. Said housing 1100 is provided with an air passage 1010 for conveying air, a gas passage 1020 for conveying gas, a mixed gas passage 1030 communicating downstream of said air passage 1010 and said gas passage 1020; said gas passage 1020 has a first shut-off portion 1021 which can be changed over flow area; and said air passage 1010 has a second shut-off portion 1011 which can be changed over flow area.

Said moving mechanism 1001 is provided with a flexible spacing member sealing said air passage 1010 and said gas passage 1020. Said moving mechanism 1001 opens into said air passage 1010 and said gas passage 1020 through said flexible spacer component and changes said first and second shut-offs 1021, 1011 through an action; said flexible spacer component is deformable with the action of said moving mechanism 1001.

The movement of the gas mixing device provided by the present embodiment by the movement mechanism 1001 can simultaneously change the over-flow areas of the first and second shut-off portions 1021, 1011, and change the input amounts of gas and air while maintaining the gas and air mixing ratio, thereby changing the mixed gas amount of the mixed gas passage 1030, and in turn, the adjustment ratio of the gas mixing device can be stably changed, and the discharge of flue gas can be stabilized.

Also, the gas mixing device of the present embodiment utilizes a flexible spacer component to space the gas passage 1020 and the air passage 1010, and the flexible spacer component can be deformed together with the action of the moving mechanism 1001 to accommodate the action of the moving mechanism 1001, thereby reducing interference with the action of the moving mechanism 1001 for the purpose of precisely controlling the intake air of gas and air.

The gas mixing device provided by the present embodiment has a greater regulation ratio, which in turn can achieve lower power, maintaining more stable low-load combustion.

The gas mixing device of the present embodiment is a venturi pipe of special construction. Wherein the air channel 1010, the gas channel 1020 and the mixed gas channel 1030 form a venturi structure. Air flows through the air channel 1010 to the mixed gas channel 1030 and creates a negative pressure draws gas in the gas channel 1020.

In the present embodiment, the first shut-off portion 1021 is the location where the overall gas channel 1020 has the smallest excess flow area, and by changing the size of the overflow area of the first shut-off portion 1021, an adjustment of how much gas is supplied to the gas channel 1020 is achieved. Accordingly, the second shut-off portion 1011 is the location where the throughflow area of the entire air passage 1010 is minimal, and by changing the throughflow area of the second shut-off portion 1011, an adjustment of how much air is supplied to the air passage 1010 is achieved.

The motor 1200 can project into the air channel 1010 through an air inlet 1101 at the lower end of the housing 1100. The motor 1200 may directly drive the movement mechanism 1001 for movement. The output shaft of the motor 1200 and the linkage rod 1013 are arranged coaxially, and the linkage rod 1013 is arranged coaxially fixedly outside the output shaft of the motor 1200. The air shut-off plate 1012 is fixedly sleeved outside the linkage rod 1013 to move synchronously with the linkage rod 1013.

Within the housing 1100 there is provided a conical tube structure forming a constricted section 1040 of the venturi structure. Wherein the gas channel 1020 is located outside the constricted section 1040. Negative pressure is created through the throat section 1050 after being accelerated by the constricted section 1040, drawing gas in the gas channel 1020.

The gas mixing device of the present embodiment achieves an adjustment of the mixing ratio of air and gas through movement of the moving mechanism 1001, and in cooperation with a change in the fan rotation speed, so that combustion is stable. The internal over-flow area of at least part of the length of the mixed gas channel 1030 gradually increases along its internal gas flow direction, forming a diffuser section of the venturi structure. Between the diffuser section and the constricted section 1040 the over-flow area flows in a substantially constant throat section 1050. A gas passage 1020 communicates with the throat section 1050. The end of the mixed gas passage 1030 forms a gas outlet 1103.

In the present embodiment, the movement mechanism 1001 may be a single element, or may be assembled and formed for multiple elements. The movement mechanism 1001 may be driven directly or indirectly by the motor 1200. The form of movement of the movement mechanism 1001 in the housing 1100 may be rotation, translation, rocking, or even a combination of actions. In the present embodiment, the movement mechanism 1001 reciprocates linearly. The motor 1200 has a motor 1200 shaft, on which motor 1200 shaft a movement mechanism 1001 can be mounted, moving axially.

In the present embodiment, the flexible spacer component is fixedly provided on the housing 1100 and fixedly connected to the moving mechanism 1001. The flexible spacer component is a flexible material, for example a rubber material. Part of the flexible spacer component is immobilized and part of the flexible spacer component moves with the action of the moving mechanism 1001. The flexible spacer component is fixedly connected between the moving mechanism 1001 and the housing 1100, spacing the air channel 1010 and the gas channel 1020. The connection portion to which the flexible spacer component is fixedly connected to the movement mechanism 1001 acts (moves) with the movement mechanism 1001, the flexible spacer component deforms to accommodate the action of the movement mechanism 1001 and maintains a sealed spacing between the air passage 1010 and the gas passage 1020.

Specifically, said housing 1100 is provided with a communication hole 1151 between said air passage 1010 and said gas passage 1020 traversed by said moving mechanism 1001. The flexible spacer part is fixedly sleeved outside the moving mechanism 1001 occludes the communication hole 1151.

Said air channel 1010 and said gas channel 1020 have a common channel wall 1150. Said communication hole 1151 is provided on said channel wall 1150 through said channel wall 1150. The flexible spacer component comprises a skin 1018 that is fixedly sleeved outside the moving mechanism 1001 to hide the communication hole 1151. The outer edge 1181 of said skin 1018 is clip-fixed; the inner edge 1182 of said skin 1018 is fixed to said movement mechanism 1001, moving linearly and reciprocally following the movement mechanism 1001.

In the present embodiment, said movement mechanism 1001 comprises an air shut-off plate 1012 driven to move axially, a gas spool 1002, and a linkage rod 1013. Said linkage rod 1013 connects said air shut-off plate 1012 and gas spool 1002, linking said gas spool 1002 with said air shut-off plate 1012.

When the linkage rod 1013 rigidly connects the air shut-off plate 1012 and the gas spool 1002 (e. g., in the form of screwing, welding, bolting, etc.), it is difficult to ensure that the air shut-off plate 1012 and the gas spool 1002 reach the blocking position accurately at the same time, e. g., on the basis that the gas spool 1002 first reaches the blocking position cannot continue to descend, if the air shut-off plate 1012 is not reset to its blocking position, and the hard connection between the air shut-off plate 1012 and the gas spool 1002 is hard, the length of the two cannot be adjusted, the air shut-off plate 1012 cannot continue to descend, so that a seal is difficult to form, and the air fuel ratio is difficult to accurately adjust.

Figure 9:
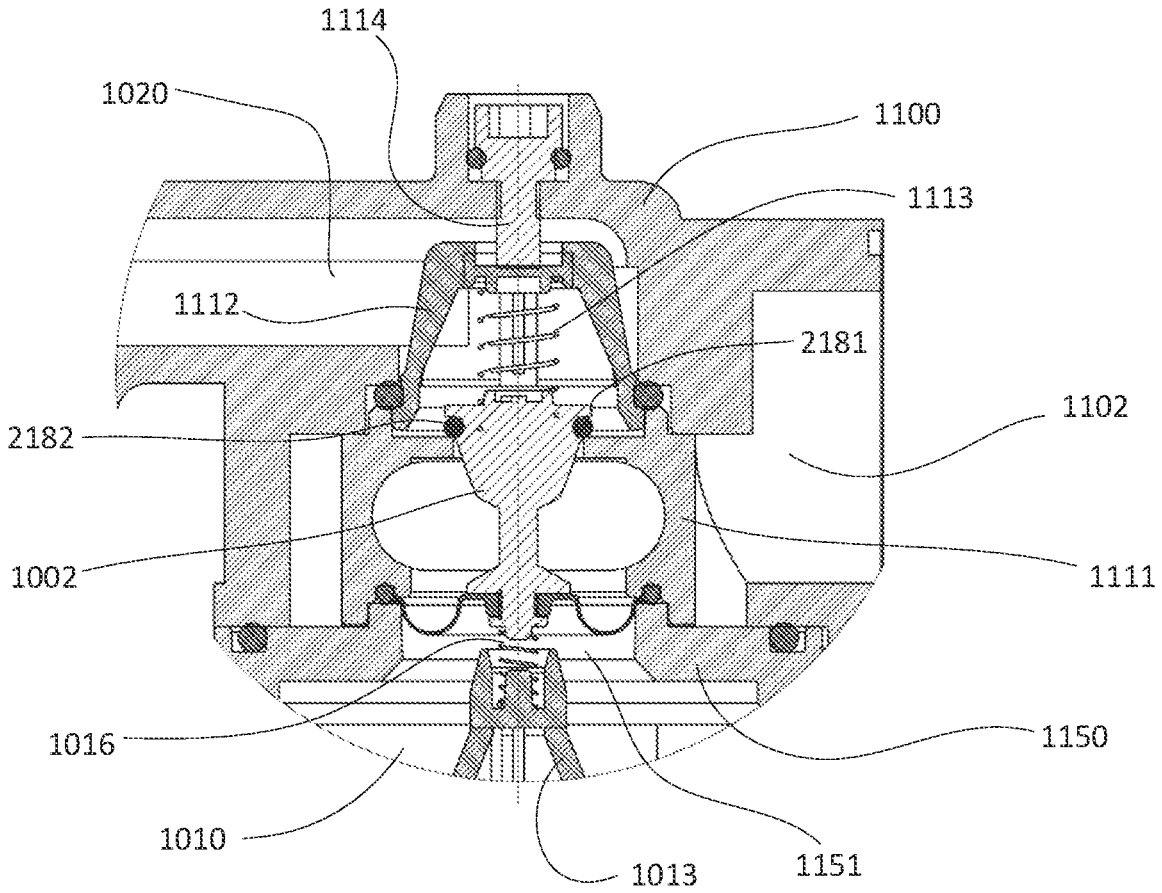
FIG. 9 is an enlargement of Part I of FIG. 8.
Figure 10:
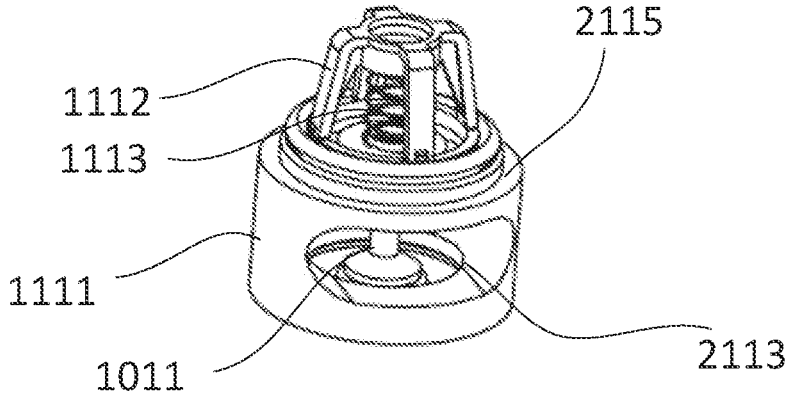
FIG. 10 is a perspective view of the gas valve seat and support bracket of FIG. 7.
Figure 11:
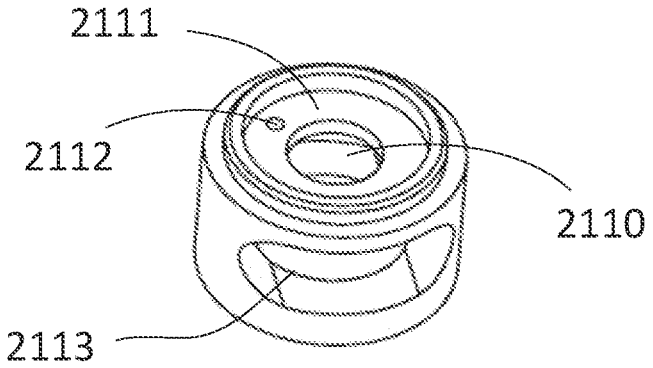
FIG. 11 is a schematic view of the gas valve seat of FIG. 10.

Based on this consideration, the linkage rod 1013 and the gas spool 1002 are connected between the first elastic member. As shown in FIG. 9, the upper end of linkage rod 1013 is a receiving groove. The first elastic member is a (cylindrical) connecting spring 1016. The lower end of the connecting spring is located in the accommodating slot and fixedly sleeved over the positioning post within the accommodating slot. The upper end of the connection spring is fixedly sleeved outside the connection projection of the connecting end 1119 (lower end) of the gas spool 1002, so that the connection spring soft-connects the linkage rod 1013 and the gas spool 1002, so that both the air shut-off plate 1012 and the gas spool 1002 can reach the blocking position accurately to seal the respective valve ports. The first elastic member is in a stretched state when the air shut-off plate 1012 and the gas spool 1002 are in the blocked position.

In this embodiment, the second shutoff 1011 is located upstream of the constricted section 1040. Said air passage 1010 has an air valve opening therein. A second shutoff 1011 is formed between the air shut-off plate 1012 and the air valve opening. The air shut-off plate 1012 has an air blocking position that blocks the air valve. The housing 1100 is provided with a reduction located at the channel wall 1150 of the air channel 1010. The reduction portion defines an air valve opening. The air passage 1010 is provided with an air inlet port 1101 upstream of the air valve port. In the present embodiment, the internal cross sectional area of the reducing portion gradually decreases along the air flow direction. When the cross section of the air passage 1010 is circular, the internal diameter of the reducing portion gradually decreases along the air flow direction. The air shut-off plate 1012 and the reduction part are reciprocated by an axial straight line to vary the over-flow area of the second shut-off part 1011.

When the air shut-off plate 1012 is in the air blocking position, the gas mixing device is further provided with a first communication connecting an air passage 1010 located downstream of the air valve with an air passage 1010 located upstream of the air valve. Specifically, said first communication portion comprises a first always through hole 1121 located on said air shut-off plate 1012 and passing said air shut-off plate 1012 through. Of course, in other embodiments, the first communication portion may also be a clearance structure of the outer edge 1181 of the air shut-off plate 1012, as the present embodiment is not the only embodiment contemplated by the inventors. By providing the first communication portion, the air shut-off plate 1012 can precisely control the small-load air-fuel ratio, reduce the minimum load and reach a high adjustment ratio.

A gas valve port 2110 is provided in said gas channel 1020. Said gas spool 1002 has a gas blocking position blocking said gas valve port 2110. When said gas spool 1002 is in said gas blocking position, said gas mixing device is further provided with a second communication portion connecting a gas passage 1020 located downstream of said gas port 2110 with a gas passage 1020 located upstream of said gas port 2110.

In other embodiments, the second communication may even be provided on the gas spool 1002, said gas spool 1002 moving axially reciprocally to change the over-flow area with said gas valve port 2110.

A gas valve seat 1111 is provided in said gas channel 1020. The gas valve seat 1111 defines a gas valve port 2110. The gas channel 1020 has a gas inlet 1102 located upstream of the gas valve 2110. A first shut-off portion 1021 is defined between the gas spool 1002 and the gas port 2110. Specifically, the upper end of the gas valve core 1002 is a mating end 1118 cooperating with the gas valve port 2110, and the other end is a connecting end 1119 (soft) connected with the linkage rod 1013. The mating end 1118 of the gas spool 1002 is of gradual arc design. Adjusting the size of the overflow area between the (first shut-off portion 1021) gas port 2110 during linear reciprocating movement is accomplished by changing the arc of the outer wall face and the gas port 2110, thereby changing the input amount of gas, thereby achieving a larger adjustment ratio.

For mounting the gas valve seat 1111, a raised step is also provided within the gas channel 1020. The gas valve seat 1111 is mounted between the raised step and the common channel wall 1150, clip-mounted and fixed. Said gas valve port 2110 and said second communication are located on said gas valve seat 1111. Said second communication comprises a second always through hole 2112 located on said gas valve seat 1111. Said second always through hole 2112 is spaced apart from said gas port 2110. When the gas valve core 1002 is in the blocking position, the first normal through hole 1121 is not blocked by the gas valve core 1002, maintaining communication between the gas valve seat 1111 up and down under a small load, maintaining stable combustion under a small load.

In other embodiments, the second communication portion may be a vent structure located at an edge of the gas valve port 2110 and is not spaced apart from the gas valve port 2110. Of course, the second communication may also be provided on other components, and not limited to on the gas valve seat 1111. The second connection portion may be, for example, a through-hole that penetrates upstream and downstream of the partition within a gas channel 1020, which simultaneously communicates upstream and downstream of the gas valve seat 1111.

Under a small load, the gas mixing device moves the air shut-off plate 1012 and the gas spool 1002 to a blocking position (which may be an initial position of the air shut-off plate 1012 and the gas spool 1002), so as to realize an input supply of air and gas through the first communication portion and the second communication portion, and since the first communication portion and the second communication portion are always on disposed, the flow area is constant, so that stable supply of air and gas can be performed under a small load, and stable combustion under a small load is achieved.

In this embodiment, said gas valve seat 1111 has a valve port end 2115 of said gas valve port 2110. The lower end of the gas valve seat 1111 is a venting end, which is located above the communication hole 1151 shielded from the skin 1018, and protrudes downwardly by the connecting end 1119 of the valve core. The sidewall of the gas valve seat 1111 is provided with a sidewall hole 2113, which opens into the interior of the gas valve seat 1111, and communicates with the gas valve port 2110, so as to realize communication between the upstream and downstream of the gas valve seat 1111. The side of said valve port end 2115 remote from said linkage rod 1013 has a guide surface 2111 recessed towards said gas port 2110. The guide surface 2111 is a concave tapered structure. By providing the tapered guiding surface 2111, it is possible to keep the gas valve core 1002 centered when reset, avoiding tilting of the gas valve core 1002 after reset, and affecting precise control of the intake amount of gas air.

In order to form a good seal in the blocking position, precise control of the minimum load is carried out with the first communication and the second communication, said air valve being located at a valve port step 1110 on the inner wall of said air passage 1010. A flange seal ring 2101 is provided on said valve port step 1110. Compression of the flange seal ring 2101 when the air shut-off plate 1012 is in the air blocking position seals off the air valve.

Further, said gas spool 1002 has a circumferential flange 2181 thereon that can be brought into contact with said guide surface 2111 to cap and seal said gas port 2110. Said gas spool 1002 is fixedly sleeved on one side of said circumferential flange 2181 with a sealing ring 2182 for sealing off said gas valve port 2110. The sealing ring 2182 is compressed between the circumferential flange 2181 and the guide surface 2111 when the gas spool 1002 is in the gas blocking position, sealing the gas valve port 2110 against leakage.

A second elastic member for applying a force to the gas spool 1002 moving towards the blocking position is also provided within the gas passage 1020. The second elastic member may apply a downward pressing force to the gas valve core 1002, with which it is not only possible to maintain a seal when the gas valve core 1002 is in the blocked position, but also to eliminate dimensional differences resulting from various component parts of the movement mechanism 1001 and the overall assembly, which are compensated for by elongation or shortening of the second elastic member.

In particular, the valve port end 2115 of said gas valve seat 1111 is also provided with a support bracket 1112. The support bracket 1112 is fixedly mounted at an upper end of the gas valve seat 1111 (valve port end 2115). The lower end of the support bracket 1112 is sheathed within an upwardly projecting ledge of the valve port end 2115 and has a sealing ring between the channel wall 1150. Said second elastic member comprises a compression spring 1113 abutting one end against said support bracket 1112 on the other end against said gas valve core 1002. The top of the support bracket 1112 has a mounting through-hole 2122, the mounting through-hole 2122 is a stepped hole, and the overcap 1116 is slidably received within the mounting through-hole 2122, and limits the uppermost position of the overcap 1116 by a limiting step within the mounting through-hole 2122.

In the present embodiment, the deformation variable when said second elastic member compresses said gas spool 1002 in said blocking position is adjustable. An overcap 1116 capable of changing position axially is accommodated on said support bracket 1112. Said compression spring 1113 is compression limited between said overcap 1116 and said gas spool 1002.

Specifically, said housing 1100 is provided with a threaded hole leading into said gas passage 1020, and a screw-fitting adjusting screw 1114 penetrating into said threaded hole. One end of said adjusting screw 1114 abuts on the side of said overcap 1116 remote from said compression spring 1113. The adjustment screw 1114 and the compression spring 1113 are located on the upper and lower sides of the overcap 1116, respectively, and the compression spring 1113 abuts the overcap 1116 upward, and the lower end of the adjustment screw 1114 abuts the overcap 1116 downward, limiting the overcap 1116. A threaded through hole is located at the top of the housing 1100 and penetrates the channel wall 1150 of the gas channel 1020. Scaling measures, such as sealing rings, are also provided between the upper end of the adjusting screw 1114 and the housing 1100 to avoid gas leakage.

Further, to guide the movement of the gas valve core 1002, a guide rod 1115 is also fixed at an upper end of the gas valve core 1002. The upper end of the guide rod 1115 projects into a guide groove of the side of the overcap 1116 facing away from the adjusting screw 1114, and axially moves with the gas valve core 1002 relative to the overcap 1116, thereby guiding the movement of the gas valve core 1002.

Figure 12:
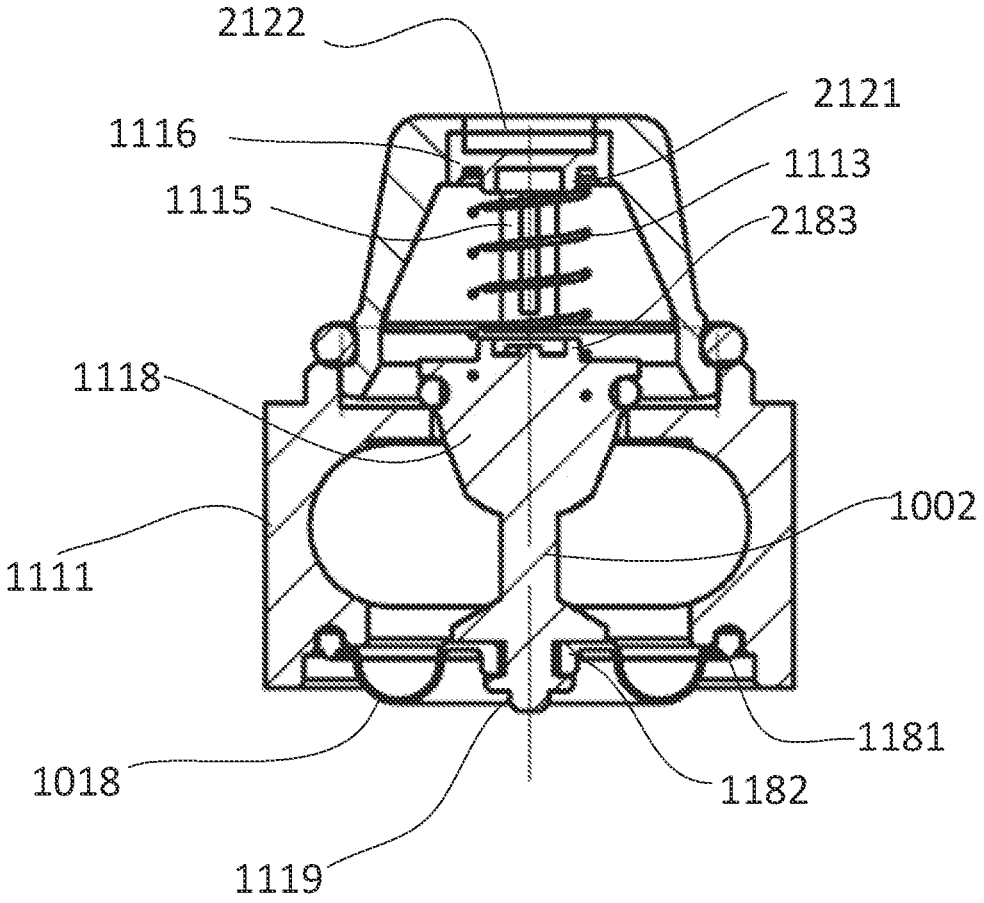
FIG. 12 is a cross-sectional view of FIG. 10.
Figure 13:
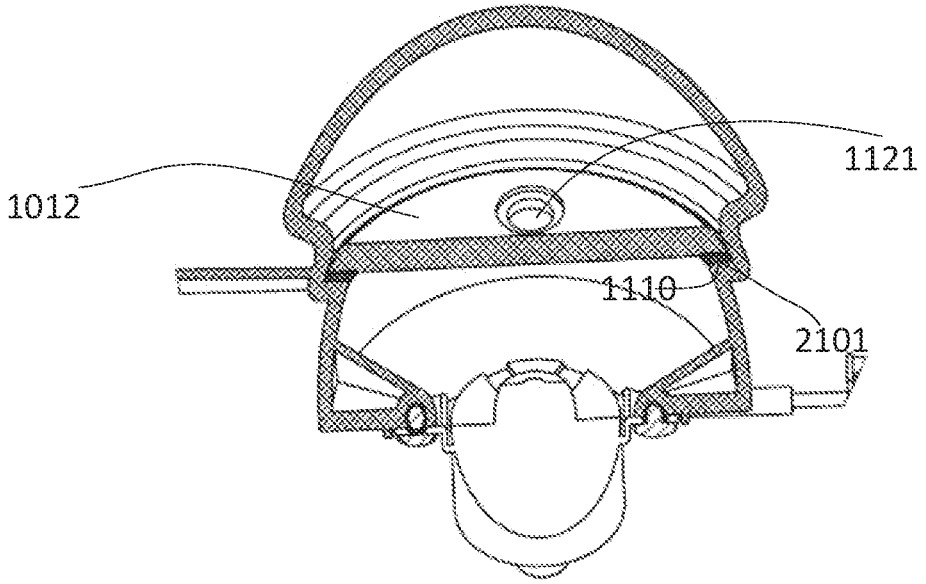
FIG. 13 is a partial schematic view of the air shut-off plate of FIG. 8.

As shown in FIGS. 9 and 12, the adjusting screw 1114 and the threaded bore threadingly cooperate, and said adjusting screw 1114 can be rotated to change the length of the screw into said threaded bore, thereby pushing the position of said overcap 1116 in the axial direction to change. Wherein, by screwing inwardly or outwardly by a certain length, the adjusting screw 1114 can change the projecting length into the gas passage 1020 by fitting the threaded hole, thereby pushing the overcap 1116 downward or moving the overcap 1116 upward, changing the axial position of the overcap 1116, thereby changing the initial form variable (compression amount) of the compression spring 1113, eliminating dimensional differences resulting from the overall assembly of the component parts of the movement mechanism 1001 and the gas mixing device.

In order to avoid exceeding the elastic limit of the compression spring 1113, ensuring precise regulation of the gas air input amount and avoiding affecting the service life of the device, said support bracket 1112 has a first protrusion 2121 protruding towards said gas spool 1002. The first protrusion 2121 is located on the overcap 1116 (the overcap 1116 is mounted in the mounting through-hole 2122 at the upper end of the support bracket 1112, and in turn the first protrusion 2121 is located on the overcap 1116 indirectly disposed at the upper end of the support bracket 1112). Said gas spool 1002 has a second protrusion 2183 protruding towards said first projection 2121. The first protrusion 2121 and the second protrusion 2183 are disposed opposite or facing each other.

Both ends of the compression spring 1113 are fixedly sleeved outside of the first protrusion 2121 and the second protrusion 2183, respectively, to provide mounting positions for the compression spring 1113. After the gas valve core 1002 is pushed upward by the linkage rod 1013 until the second protrusion 2183 contacts the first protrusion 2121, reaching the top dead center position of the gas valve core 1002, the upward movement cannot be continued, so that a compression limit for compressing the compression spring 1113 is avoided, thereby breaking the elasticity of the compression spring 1113, thereby ensuring precise regulation of the gas air.

Any numeral values cited in this text include all values of the lower values and the upper values from the lower limit value to the upper limit value, in increments of one unit, provided that there is a separation of at least two units between any lower value and any higher value. For example, if a value illustrating the number or process variable (such as temperature, pressure and time, etc.) of a component is from 1 to 90, preferably from 20-80, and more preferably from 30 to 70, then the purpose is to explain that the Description also explicitly enumerates values such as 15 to 85, 22 to 68, 43 to 51 and 30 to 32. For values which are less than one, one unit is appropriately considered to be 0. 0001, 0. 001, 0. 01 or 0.1. These are only examples intended to be explicitly expressed, and all possible combinations of numerical values between the lowest value and the highest value enumerated are all expressly stated in the Description in similar ways.

Unless otherwise stated, all ranges include the endpoints and all numbers that fall between the endpoints. The use of "about" or "approximately" together with a range applies to both ends of the range. Therefore, "about 20 to 30" is intended to cover "about 20 to about 30", inclusive of at least the specified endpoints.

All disclosed articles and reference materials, including patent applications and publications, are incorporated herein by reference. The term "substantially formed of . . . " describing combinations should include the determined elements, components, parts or steps as well as other elements, components, parts or steps that do not affect the basic novel features of the combination in substance. The use of the term "contain" or "include" to describe the combinations of elements, components, parts or steps herein also give rise to the embodiments constituted substantially by these elements, components, parts or steps. The term "may" as used herein is intended to explain that any attribute included by the "may" as described is selectable.

Multiple elements, components, parts or steps can be provided by a single integrated element, component, part or step. Alternatively, a single integrated element, component, part or step can be divided into multiple separate elements, components, parts or steps. The disclosed "a" or "an" used for describing elements, components, parts or steps do not exclude other elements, components, parts or steps.

It is to be understood that the above description is intended to be graphically illustrative and not restrictive. Many embodiments and applications other than the examples provided would be apparent to those skilled in the art upon reading the above description. Therefore, the scope of the present teaching should not be determined with reference to the above description, but should, instead, be determined with reference to the appended claims, along with the full scope of the equivalents thereof. The disclosures of all articles and references, including patent applications and publications, are incorporated by reference for all purposes. The omission in the foregoing claims of any aspect of the subject matter that is disclosed herein is not a disclaimer of this subject matter, nor should it be regarded as the inventors not considering this subject matter to be a part of the disclosed utility model subject matter.

What is claimed is:

1. A gas-mixing device, comprising:

a shell, wherein the shell is provided with an air channel for conveying air, a fuel gas channel for conveying fuel gas, and a mixing-gas channel communicating with lower reaches of the air channel and the fuel gas channel, wherein the fuel gas channel comprises a first cut-off portion having a changable flow area and the air channel comprises a second cut-off portion having a changeable flow area;

a movable mechanism arranged in the shell, and a flexible separation component which separates the air channel and the fuel gas channel, wherein the movable mechanism penetrates through the flexible separation component and enters the air channel and the fuel gas channel and performs a motion to change the flexible area of the first cut-off portion and the flow area of the second cut-off portion, and the flexible separation component is able to deform as the movable mechanism performs the motion, wherein the movable mechanism comprises an air cut-off plate which is driven to move axially, a fuel gas valve core, and a linkage rod, wherein the linkage rod connects with the air cut-off plate and the fuel gas valve core so as to link the fuel gas valve core and the air cut-off plate, and wherein the linkage rod and the fuel gas valve core are connected via a connecting spring.

2. The gas-mixing device according to claim 1, wherein the movable mechanism performs a linear reciprocating motion.

3. The gas-mixing device according to claim 1, wherein a part of the flexible separation component is stable, and another part of the flexible separation component moves along with the movement of the movable mechanism.

4. The gas-mixing device according to claim 1, wherein the shell is provided with a connection hole, through which the movable mechanism penetrates, between the air channel and the fuel gas channel, and the flexible separation component is sleeved on the movable mechanism to shield and seal the connection hole.

5. The gas-mixing device according to claim 4, wherein the air channel and the fuel gas channel have a shared wall, the connection hole is provided in the shared wall and penetrates through the shared wall, wherein the flexible separation component comprises a rubber membrane which is fixedly sleeved on the movable mechanism to shield and seal the connection hole.

6. The gas-mixing device according to claim 5, wherein an outer periphery of the rubber membrane is fixed by clamping and an inner periphery of the rubber membrane is fixed onto the movable mechanism.

7. A gas-mixing device, comprising:

a shell, wherein the shell is provided with an air channel for conveying air, a fuel gas channel for conveying fuel gas, and a mixing-gas channel communicating with lower reaches of the air channel and the fuel gas channel, wherein the fuel gas channel comprises a first cut-off portion having a changable flow area and the air Channel comprises a second cut-off portion having a changeable flow area;

a movable mechanism arranged in the shell, and a flexible separation component which separates the air channel and the fuel gas channel, wherein the movable mechanism penetrates through the flexible separation component and enters the air channel and the fuel gas channel and performs a motion to change the flexible area of the first cut-off portion and the flow area of the second cut-off portion, and the flexible separation component is able to deform as the movable mechanism performs the motion, wherein the movable mechanism comprises an air cut-off plate which is driven to move axially, a fuel gas valve core, and a linkage rod, wherein the linkage rod connects with the air cut-off plate and the fuel gas valve core so as to link the fuel gas valve core and the air cut-off plate, and wherein an air valve port is provided in the air channel, the air cut-off plate has an air blocking position to block the air valve port, wherein in response to the air cut-off plate being located at the air blocking position, the gas-mixing device also includes a first connection portion which communicates the air channel located at lower reach of the air valve port with the air channel located at upper reach of the air valve port.

8. The gas-mixing device according to claim 7, wherein the first connection portion comprises a first constantly open hole which is arranged in the air cut-off plate and penetrates through the air cut-off plate.

9. The gas-mixing device according to claim 7, wherein the air valve port is located at a valve port step on an inner wall of the air channel, the valve port step is provided with a flange sealing ring, and the air cut-off plate, when located at the air blocking position, presses the flange sealing ring to hermetically blocks the air valve port.

10. A gas-mixing device, comprising:

a shell, wherein the shell is provided with an air channel for conveying air, a fuel gas channel for conveying fuel gas, and a mixing-gas channel communicating with lower reaches of the air channel and the fuel gas channel, wherein the fuel gas channel comprises a first cut-off portion having a changable flow area and the air Channel comprises a second cut-off portion having a changeable flow area;

a movable mechanism arranged in the shell, and a flexible separation component which separates the air channel and the fuel gas channel, wherein the movable mechanism penetrates through the flexible separation component and enters the air channel and the fuel gas channel and performs a motion to change the flexible area of the first cut-off portion and the flow area of the second cut-off portion, and the flexible separation component is able to deform as the movable mechanism performs the motion, wherein the movable mechanism comprises an air cut-off plate which is driven to move axially, a fuel gas valve core, and a linkage rod, wherein the linkage rod connects with the air cut-off plate and the fuel gas valve core so as to link the fuel gas valve core and the air cut-off plate, and wherein a fuel gas valve port is provided in the fuel gas channel, the fuel gas valve core has a fuel gas blocking position at which the fuel gas valve port is blocked, wherein in response to the fuel gas valve core being located at the fuel gas blocking position, the gas-mixing device also includes a connection portion which communicates the fuel gas channel located at lower reach of the fuel gas valve port with the fuel gas channel located at upper reach of the fuel gas valve port.

11. The gas-mixing device according to claim 10, wherein a fuel gas valve seat is provided in the fuel gas channel, and the fuel gas valve port and the connection portion are both located on the fuel gas valve seat.

12. The gas-mixing device according to claim 11, wherein the connection portion comprises a constantly open hole provided in the fuel gas valve seat, and the constantly open hole is isolated from the fuel gas valve port.

13. The gas-mixing device according to claim 11, wherein the fuel gas valve seat comprises a valve port end for the fuel gas valve port, the valve port end comprises a guiding surface that is concave towards the fuel gas valve port at a side away from the linkage rod, and wherein the fuel gas valve core comprises a circumferential protruding periphery which is in contact with the guiding surface and covers and blocks the fuel gas valve port.

14. The gas-mixing device according to claim 13, wherein a sealing ring is set to seal and block the fuel gas valve port at a side of the fuel gas valve core circumferential protruding periphery.

15. The gas-mixing device according to claim 11, wherein an elastic piece is provided in the fuel gas channel and is configured to apply a force to the fuel gas valve core to cause the fuel gas valve core to move towards the blocking position.

16. The gas-mixing device according to claim 15, wherein deformation of the elastic piece when the elastic piece presses and fixes the fuel gas valve core at the blocking position is adjustable.

17. The gas-mixing device according to claim 15, wherein the valve port end of the fuel gas valve seat is further provided with a supporting holder, and the elastic piece comprises a pressure spring having one end abutting against the supporting holder and another end abutting against the fuel gas valve core.

18. The gas-mixing device according to claim 17, wherein the supporting holder accommodates a top hat which is able to move axially, and wherein the pressure spring is compressed and limited between the top hat and the fuel gas valve core.

19. The gas-mixing device according to claim 18, wherein the shell is provided with a screw-thread hole which stretches into the fuel gas channel and an adjustment screw which is in screw-thread fit with and penetrates through the screw-thread hole, an end of the adjustment screw abuts against a side of the top hat away from the pressure spring, and a length of a part of the adjustment screw, said part being screwed into the screw-thread hole, is changeable by rotating the adjustment screw so as to change a position of the top hat in an axial direction of the top hat.

20. The gas-mixing device according to claim 17, wherein the supporting holder comprises a first bulge which protrudes towards the fuel gas valve core, the fuel gas valve core comprises a second bulge which protrudes towards the first bulge, and two ends of the pressure spring are sleeved on the first bulge and the second bulge respectively.

* * * * *